US011839261B2

(12) United States Patent
Go

(10) Patent No.: US 11,839,261 B2
(45) Date of Patent: Dec. 12, 2023

(54) SHOCK-ABSORBING HEEL HAVING SHOCK ABSORBER AND ATTACHED TO HIGH HEEL

(71) Applicant: Jong Taek Go, Goyang-si (KR)

(72) Inventor: Jong Taek Go, Goyang-si (KR)

( * ) Notice: Subject to any disclaimer, the term of this patent is extended or adjusted under 35 U.S.C. 154(b) by 116 days.

(21) Appl. No.: 17/437,817

(22) PCT Filed: Jan. 10, 2020

(86) PCT No.: PCT/KR2020/000449
§ 371 (c)(1),
(2) Date: Sep. 9, 2021

(87) PCT Pub. No.: WO2020/246682
PCT Pub. Date: Dec. 10, 2020

(65) Prior Publication Data

US 2022/0151340 A1 May 19, 2022

(30) Foreign Application Priority Data

Jun. 3, 2019 (KR) ..... 10-2019-0065368

(51) Int. Cl.
*A43B 21/30* (2006.01)

(52) U.S. Cl.
CPC ..... *A43B 21/30* (2013.01)

(58) Field of Classification Search
CPC ..... A43B 21/26; A43B 21/30; A43B 21/32
See application file for complete search history.

(56) References Cited

U.S. PATENT DOCUMENTS 2,807,100 A * 9/1957 Windle ..... A43B 21/26 36/38
4,848,008 A * 7/1989 Kuehnle ..... A43B 21/26 36/35 R (Continued)

FOREIGN PATENT DOCUMENTS

KR 20-1993-0000116 1/1993
KR 20-0393493 8/2005

(Continued)

OTHER PUBLICATIONS

English Specification of 10-0975053, as filed on Sep. 9, 2021.

(Continued)

*Primary Examiner* — Ted Kavanaugh
(74) *Attorney, Agent, or Firm* — ANTONIO HA & U.S. PATENT, LLC

(57) ABSTRACT

The present invention relates to a shock-absorbing heel provided with a shock absorber for mitigating the load applied to the sole of a foot when walking and, more specifically, to a shock-absorbing heel provided with a shock absorber and attached to a high heel, the shock-absorbing heel comprising, an outer heel fixedly mounted to the rear surface of the sole of a high heel (shoe), an inner heel which has an elastic spring mounted to the upper side thereof and is coupled to the inside of the outer heel, and a bottom heel which is fixedly mounted to a lower end portion of the inner heel so as to be replaceable, wherein a cylindrical protective cap which is inserted so as to prevent the lower end portion of the inner heel from being exposed to the outside is provided on a lower end portion of the outer heel, and a fastening cover coupled to the inner heel above the elastic spring is inserted into the outer heel. Thus, the outer heel slides up and down by virtue of the elastic spring to mitigate shock when walking.

6 Claims, 6 Drawing Sheets

(56) References Cited

U.S. PATENT DOCUMENTS

| | | | | |
|---|---|---|---|---|
| 2008/0034620 | A1* | 2/2008 | Gallegos | A43B 21/30 36/36 R |
| 2009/0183391 | A1* | 7/2009 | Gallegos | A43B 13/37 36/88 |
| 2014/0196319 | A1* | 7/2014 | Rupprecht | A43B 21/26 36/105 |

FOREIGN PATENT DOCUMENTS

| | | |
|---|---|---|
| KR | 20-0403451 | 12/2005 |
| KR | 10-2008-0056695 | 6/2008 |
| KR | 10-2009-0109392 | 10/2009 |
| KR | 20-0446957 | 12/2009 |
| KR | 10-0975053 | 8/2010 |
| KR | 10-1009578 | 1/2011 |
| KR | 20-2012-0007355 | 1/2012 |
| KR | 10-1465229 | 11/2014 |
| KR | 10-2016-0005318 | 1/2016 |
| KR | 10-2067807 | 1/2020 |

OTHER PUBLICATIONS

English Specification of 20-2012-0007355, as filed on Sep. 9, 2021.
English Specification of 10-2008-0056695, as filed on Sep. 9, 2021.
English Specification of 10-1009578, as filed on Sep. 9, 2021.
English Specification of 20-1993-0000116, as filed on Sep. 9, 2021.
English Specification of 10-1465229, as filed on Sep. 9, 2021.
English Specification of 20-0403451, as filed on Sep. 9, 2021.
English Specification of 20-0393493, as filed on Sep. 9, 2021.
English Specification of 20-0446957, as filed on Sep. 9, 2021.
English Specification of 10-2067807, as filed on Sep. 9, 2021.
English Specification of 10-2009-0109392, as filed on Sep. 9, 2021.
English Specification of 10-2016-0005318, as filed on Sep. 9, 2021.

* cited by examiner (a)

(b)

SHOCK-ABSORBING HEEL HAVING SHOCK ABSORBER AND ATTACHED TO HIGH HEEL

TECHNICAL FIELD

The present invention relates to a heel for absorbing shocks, having a shock absorber to mitigate the load applied to the sole of a foot when walking and, more specifically, to a heel for absorbing shocks, having a shock absorber and attached to a high heel shoe includes an outer heel fixedly installed on a rear surface of a sole of a high heel shoe, an inner heel having an elastic spring installed at an upper side thereof and coupled inside the outer heel, and a top piece fixedly installed on a lower end of the inner heel to be replaceable, wherein a cylindrical protection cap is inserted and installed over a lower end of the outer heel to prevent the lower end of the inner heel 120 from being exposed to the outside, and a fastening cover coupled from over the inner heel and the elastic spring is inserted into the outer heel, and impact may be mitigated by the elastic spring while the outer heel slidingly ascends or descends when walking.

BACKGROUND ART

Women enjoy wearing pretty high heels, and these high heels are said to be the perfection of fashion as a woman's dream.

In particular, high heels may make ones look taller and go well with clothes they wear and create various fashion styles, so have been recognized as a must-have item for teen girls through old ladies for a very long time.

In this way, high heels have the charm of increasing height, decorating the body and making clothes look beautiful, and freely coordinating fashion styles. However, due to their height, high heels may deliver shocks to the feet, knees, waist, and the whole body, causing feet disease or discomfort and pain and damage to the feet, knees, and waist.

To address the foregoing issues, there are proposed a few conventional techniques that have a common elastic member, e.g., rubber, inside the heels or use elastic members, such as springs.

Among such conventional techniques, Korean Utility Model Registration No. 20-0403451 discloses a 'shock-absorbing shoes for women' which has a heel with a proper height at the bottom back of the shoe and a shock absorbing means to minimize shocks exerted to the user's heel while walking, wherein the shock absorbing means includes a barrel-shaped housing with a closed top and an open bottom and having upright guide holes formed through two opposite portions of the circumferential surface thereof and a shock absorbing member provided on each of an upper and lower surface of the guide hole, pipe-shaped elevation members having pin-shaped protrusions facing each other at the upper end of the outer circumferential surface and positioned inside the guide holes to be able to ascend or descent at an appropriate height inside the housing, a fixing member fixed to the bottom of the inner circumferential surface of the elevation member and having an open top and a closed bottom, and an elastic member disposed between the ceiling of the housing and the bottom of the fixing member to apply elastic force to the fixing member.

Further, Korean Utility Model Registration No. 20-0393493 discloses a 'shoe heel for absorbing shocks' in which the sole attached to the heel has high cusionability due to hydraulic pressure to mitigate shocks transferred to the ankles and knees while walking.

The conventional shoes are configured to have a shock absorbing member inside the sole. Thus, it is difficult to manufacture heels with a shock absorbing member. Further, the mounting structure is complicated and so is the process of mounting the shock absorbing member. Due to these difficulties, there is also a burden of changing the structure of the shoe to install the shock absorbing member and additionally purchasing manufacturing equipment.

Further, the conventional shoe heels have difficulty in quickly attaching or replacing or repair necessary parts, leading to significant economic loss and poor durability and convenience.

To solve these problems, the present applicant filed Korean Patent Application No. 10-2019-0030741, titled "shock absorbing heel attached to high heel." However, when the outer heel is impacted or slid from a side in the shock absorbing heel, the elastic spring may be moved inside the outer heel, causing noise or poor stability.

PRIOR TECHNICAL DOCUMENTS

Patent Documents (Patent Document 1) Korean Utility Model Registration No. 20-0403451 registered on Dec. 5, 2005.

(Patent Document 2) Korean Utility Model Registration No. 20-0393493 registered on Aug. 16, 2016.

(Patent Document 3) Korean Utility Model Registration No. 20-0446957 registered on Dec. 3, 2009.

(Patent Document 4) Korean Patent Application No. 10-2019-0030741 filed on Mar. 18, 2019.

DETAILED DESCRIPTION OF THE PRESENT INVENTION

Technical Problems

The present invention has been conceived to address the foregoing problems.

The present invention aims to provide a heel for absorbing shocks, having a shock absorber and attached to a high heel shoe, which includes an outer heel fixedly installed on a rear surface of a sole of a high heel shoe, an inner heel having an elastic spring at an upper side thereof and coupled into the outer heel, and a top piece inserted into the outer heel to be replaceable and may mitigate the impact applied to the user's body while the outer heel is slid up or down by the elastic spring.

Another object of the present invention is to insert and install a cylindrical protection cap over a lower end of the outer heel to prevent a lower end of the inner heel from being exposed to the outside to thereby provide an aesthetic look while preventing influx of dust to the inner heel, significantly enhancing use durability.

Another object of the present invention is to provide promotional effects for the shock-absorbing heel by displaying, e.g., a brand name, on the outer surface of the protection cap.

Another object of the present invention is to provide a stepped portion, which has a larger diameter than the inner heel upper portion and the inner heel lower portion, between the inner heel upper portion and the inner heel lower portion in the inner heel coupled into the outer heel to fixedly fit the elastic spring over the inner heel upper portion and fixedly insert the fastening cover, where the inner heel upper portion and the upper surface of the elastic spring are inserted, not to fall down the outer heel, increasing fastening stability.

Another object of the present invention is to limit the movement of the elastic spring by the fastening cover and the inner heel inserted into the outer heel and distribute the impact force, leading to increased sturdiness and durability.

Another object of the present invention is to inject a lubricant into the inside of the outer heel where the elastic spring and the inner heel are inserted, preventing clunking noises between the structures and install the packing portion fitted over the inner heel lower portion under the stepped portion and inside the outer heel to prevent the lubricant from dropping and leaking, thus increasing durability.

Another object of the present invention is to a heel for absorbing shocks, having a shock absorber and attached to a high heel shoe, in which the protection cap may easily be attached or removed by the user for replacement or design changing purposes.

Means to Address the Problems

To achieve the foregoing objectives, the present invention comprises an outer heel 110 fixed to a lower rear surface of a sole 101 of the high heel shoe, an inner heel 120 inserted and coupled into the outer heel 110 and including an inner heel upper portion 121 formed at an upper side, an inner heel lower portion 122 formed at a lower side, and a stepped portion 121*a* formed to have a larger diameter than the inner heel upper portion 121 between the inner heel upper portion 121 and the inner heel lower portion 122, an elastic spring 130 positioned inside the outer heel 110, fitted over the inner heel upper portion 121, and stuck to an upper portion of the stepped portion 121*a* to be compressed when the outer heel 110 descends, a top piece 140 coupled to a lower end of the inner heel lower portion 122 and supported on a ground, and a fastening cover 160 positioned over the inner heel 120 and having an upper hole 163 with an open upper surface, the inner heel 120 and the elastic spring 130 inserted into the fastening cover 160.

According to the present invention, the fastening cover 160 includes an inner heel support 161, into which the inner heel upper portion 121 is inserted, and an elastic spring support 162, into which the elastic spring 130 and the inner heel upper portion 121 are inserted, under the inner heel support 161, the elastic spring support 162 having a larger diameter than the inner heel support 161. A fastening screw thread 164 is formed on an outer circumferential surface of the fastening cover 160 and is screwed with the outer heel 110 to determine a height of the outer heel 110.

According to the present invention, the outer heel 110 includes a larger-diameter path portion 111 to seat the fastening cover 160, a medium-diameter path portion 112 communicating with the larger-diameter path portion 111 and to allow the inner heel upper portion 121 and the elastic spring 130 to be positioned therein, a bottleneck space portion 113 communicating with the medium-diameter path portion 112 and positioned under the medium-diameter path portion 112 to seat the stepped portion 121*a*, and a smaller-diameter path portion 114 communicating with the bottleneck space portion 113 and positioned under the bottleneck space portion 113 to allow the inner heel lower portion 122 to be inserted thereto, the smaller-diameter path portion 114 having a smaller diameter than the bottleneck space portion 113.

According to the present invention, a lower end of the inner heel lower portion 122 is projected downwards beyond a lower end of the outer heel 110 to be exposed to an outside and connected to the top piece 140. If a load from a user is applied, an end of the outer heel 110 comes in contact with the top piece 140. The heel further comprises a protection cap 150 having an upper end positioned higher than the lower end of the outer heel 110 and a lower end positioned over the top piece 140, inserted while surrounding the outer heel 110 to block the lower end of the inner heel lower portion 122 to an outside, and allowing the outer heel 110 to be moved up or down thereinside by the user's load.

According to the present invention, the inner heel 120 includes the inner heel upper portion 121 and the inner heel lower portion 122 separately formed. A fitting portion 121*b* protrudes from a lower portion of the stepped portion 121*a* to be fitted into an upper portion of the inner heel lower portion 122.

According to the present invention, a lubricant 190 is injected to the larger-diameter path portion 111 and the medium-diameter path portion 112 of the outer heel 110. A packing portion 123 is fitted over a lower end of the stepped portion 121*a* to prevent leakage of the lubricant 190. The packing portion 123 is inserted into the bottleneck space portion 113.

According to the present invention, the inner heel upper portion 121 protrudes through the upper hole 163 when the outer heel 110 descends.

Effects of the Invention

Therefore, in the heel for absorbing shocks, having a shock absorber and attached to a high heel shoe according to the present invention, the outer heel, the inner heel, and the top piece are configured to be separated from each other on the rear surface of the sole of the high heel shoe, thus allowing for easy and convenient attaching, detaching, replacing, and repair while mitigating the impact applied to the user's body while walking.

Further, according to the present invention, it is possible to insert and install a cylindrical protection cap over a lower end of the outer heel to prevent a lower end of the inner heel from being exposed to the outside to thereby provide an aesthetic look while preventing influx of dust to the inner heel, significantly enhancing use durability.

Further, according to the present invention, a brand name may be formed on the outer surface of the protection cap, allowing for effective promotion of the heel for absorbing shocks of the present invention.

Further, according to the present invention, it is possible to form a stepped portion, which has a larger diameter than the inner heel upper portion and the inner heel lower portion, between the inner heel upper portion and the inner heel lower portion in the inner heel coupled into the outer heel to fixedly fit the elastic spring over the inner heel upper portion and fixedly insert the fastening cover, where the inner heel upper portion and the upper surface of the elastic spring are inserted, not to fall down the outer heel or move to two opposite sides, increasing fastening stability.

Further, according to the present invention, it is possible to limit the movement of the elastic spring by the fastening cover and the inner heel inserted into the outer heel and distribute the impact force, leading to increased sturdiness and durability.

Further, according to the present invention, a lubricant may be injected into the inside of the outer heel where the elastic spring and the inner heel are inserted, preventing clunking noises between the structures. The packing portion fitted over the inner heel lower portion is installed under the stepped portion and inside the outer heel to prevent the lubricant from dropping and leaking, thus increasing durability.

Further, according to the present invention, the protection cap may easily be attached or removed by the user for replacement or design changing purposes.

BEST MODE TO PRACTICE THE INVENTION

Figure 1A:
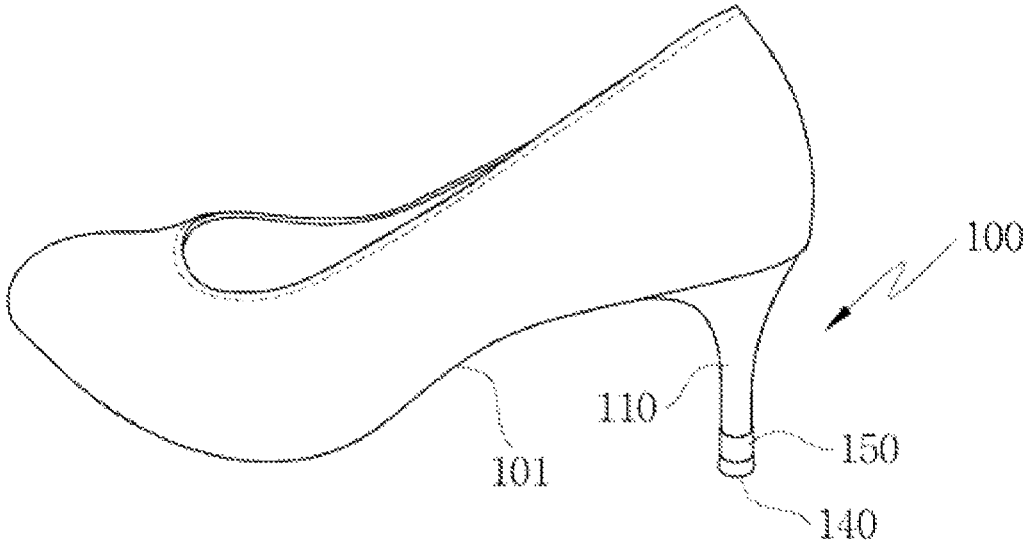
FIG. 1A is a perspective view illustrating a state in which a heel for absorbing shocks, having a shock absorber and attached to a high heel shoe, is coupled to a high heel shoe according to an embodiment of the present invention.
Figure 1B:
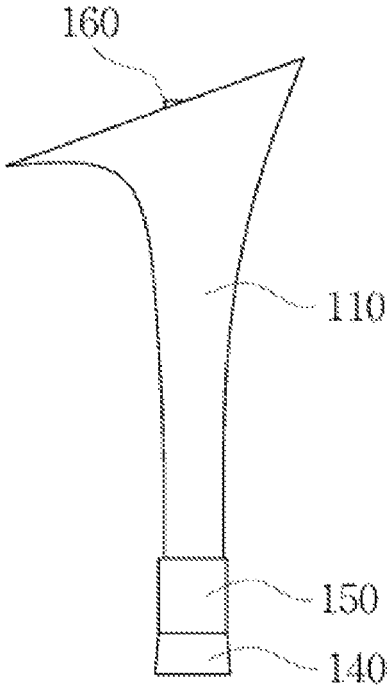
FIG. 1B is a side view illustrating a heel for absorbing shocks, having a shock absorber and attached to a high heel shoe, according to the present invention.
Figure 2A:
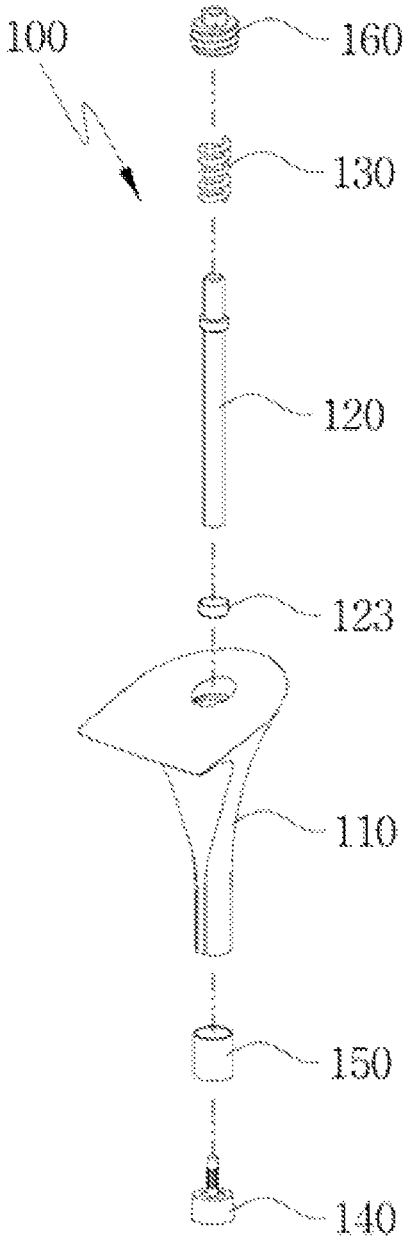
FIG. 2A is a perspective view illustrating a state in which a heel for absorbing shocks with a shock absorber is separated according to the present invention.
Figure 2B:
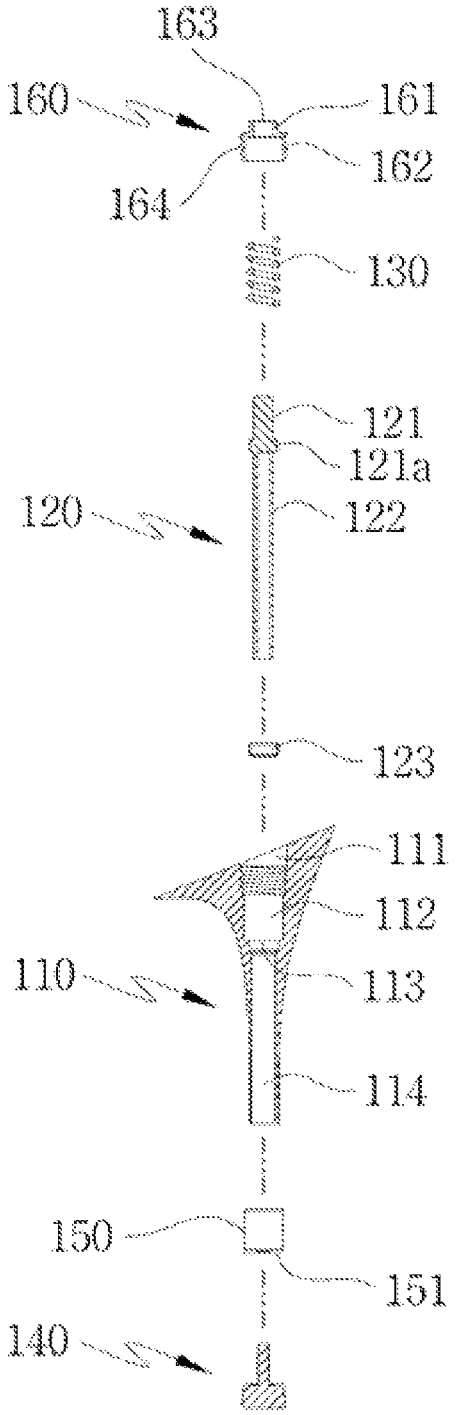
FIG. 2B is a side cross-sectional view illustrating a state in which a heel for absorbing shocks with a shock absorber is separated according to the present invention.
Figure 3:
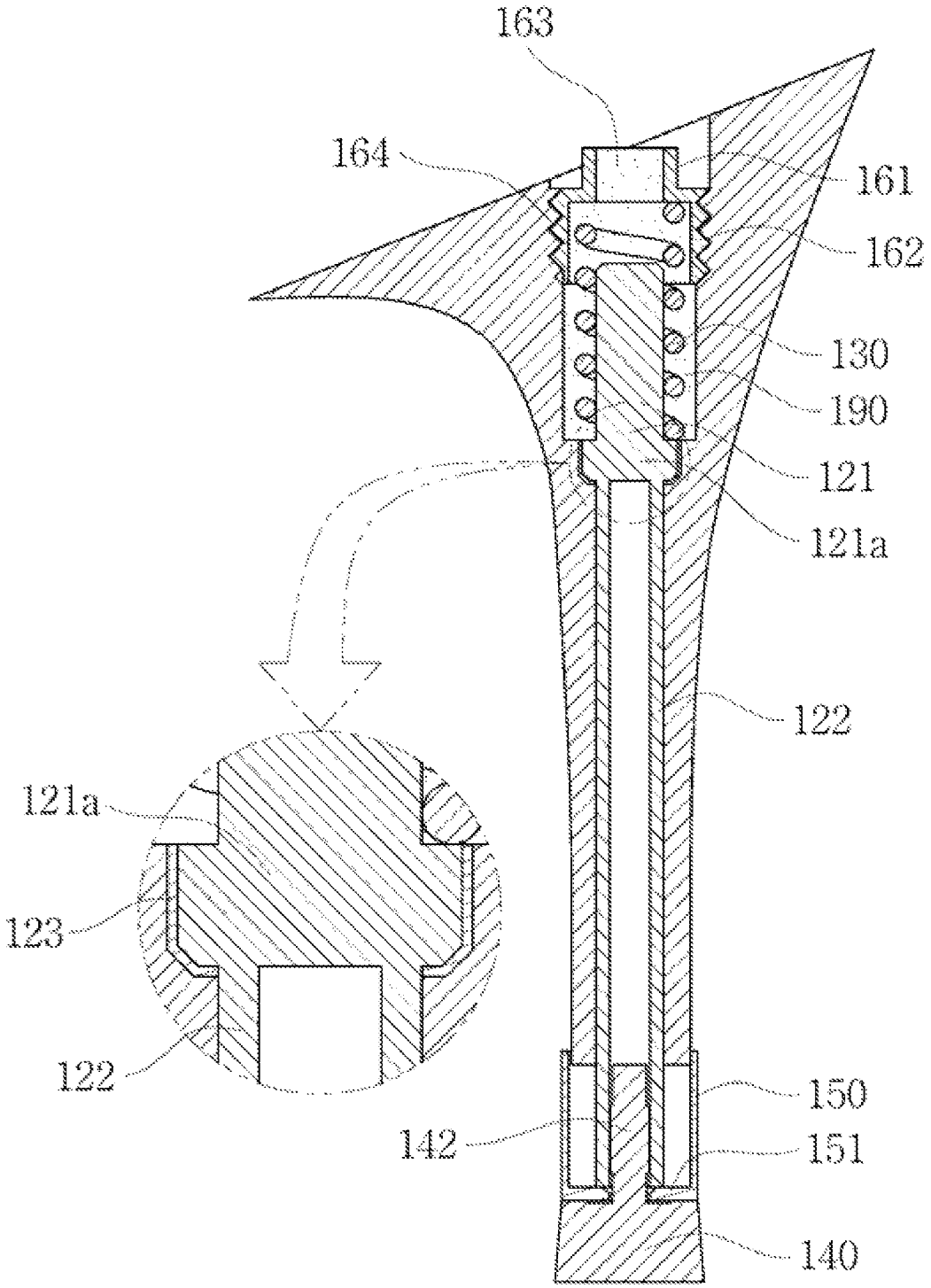
FIG. 3 is a cross-sectional view illustrating a state before a load is applied to a heel for absorbing shocks, having a shock absorber and attached to a high heel shoe according to the present invention.
Figure 4:
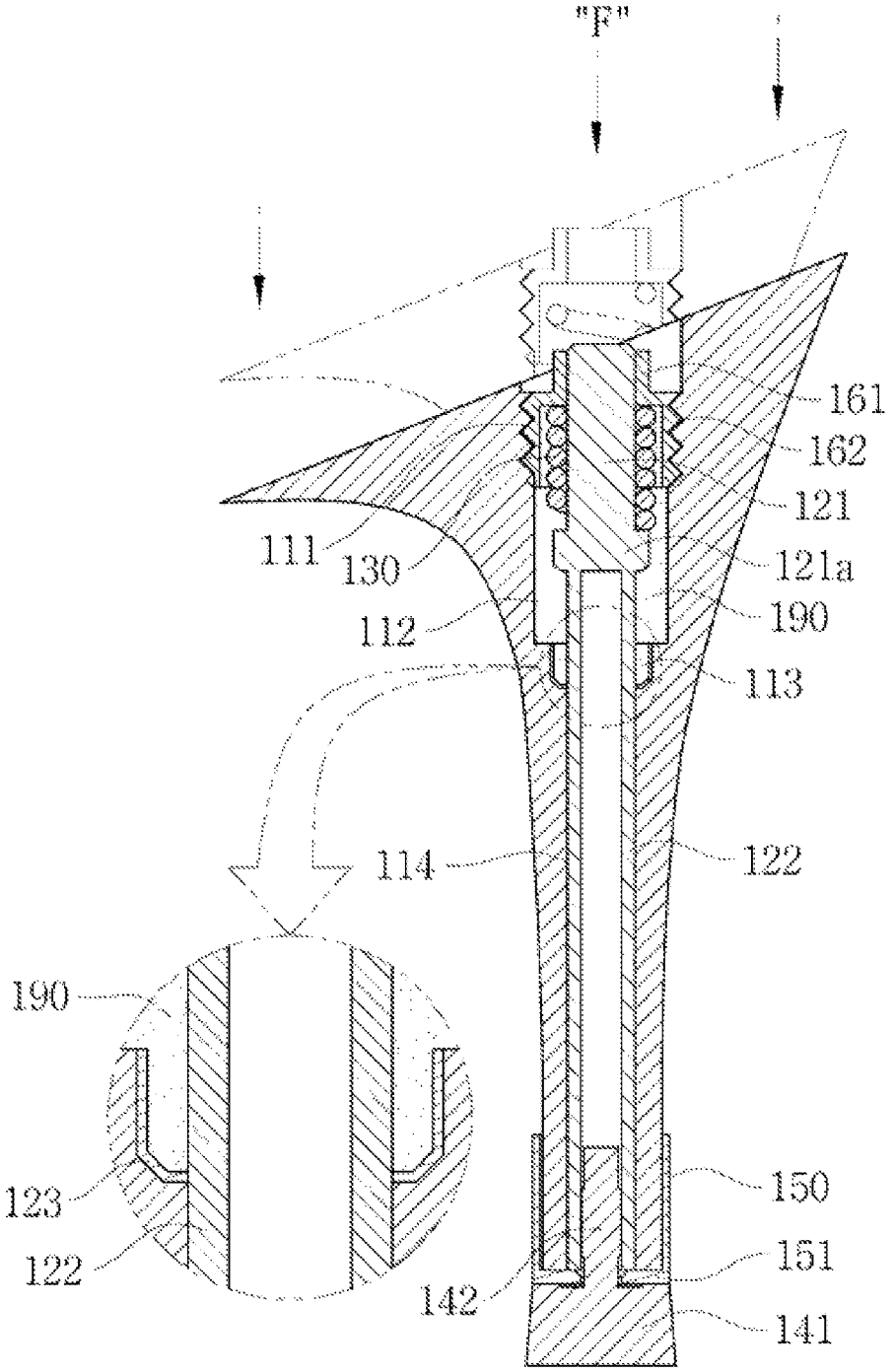
FIG. 4 is a cross-sectional view illustrating an operational state in which a shock is mitigated in a state in which a load is applied to a heel for absorbing shocks, having a shock absorber and attached to a high heel shoe according to the present invention.

Hereinafter, preferred embodiments of the present invention are described with reference to the accompanying drawings to be easily practiced by one of ordinary skill in the art.

Referring to FIGS. 1 to 6, according to the present invention, a heel 100 for absorbing shocks, having a shock absorber and attached to a high heel shoe includes.

an outer heel 110 fixed to a rear lower surface of a sole 101 of a high heel shoe and having a body portion with a broad upper surface and narrowing toward a lower surface thereof;

an inner heel 120 inserted and coupled into the outer heel 110 and including a cylindrical inner heel upper portion 121 formed at an upper side thereof, a hollow cylindrical inner heel lower portion 122 formed at a lower side thereof, and a stepped portion 121*a* formed between the inner heel upper portion 121 and the inner heel lower portion 122 and having a diameter larger than the inner heel upper portion 121 and the inner heel lower portion 122;

an elastic spring 130 positioned inside the outer heel 110, fitted over the inner heel upper portion 121, and stuck to an upper portion of the stepped portion 121*a* and compressed when the outer heel 110 descends;

a top piece 140 inserted into a lower end of the inner heel lower portion 122 and supported on the ground; and a fastening cover 160 positioned inside the outer heel 110 and allowing the inner heel 120 and the elastic spring 130 to be inserted thereinto.

The lower end of the inner heel lower portion 122 protrudes downward further than a lower end of the outer heel 110 to be exposed to the outside and connected to the top piece 140.

If the user's load is applied, an end of the outer heel 110 comes into contact with the top piece 140.

The heel 100 includes a protection cap 150 positioned higher than the lower end of the outer heel 110. A lower end of the protection cap 150 is positioned over the top piece 140. The protection cap 150 is inserted to surround the outer heel 110 to block the lower end of the inner heel lower portion 122 from the outside and allows the outer heel 110 to be moved up and down thereinside by the user's weight.

Although the inner heel 120 is described and shown as having a circular shape in the drawings, it may be changed to have a polygonal shape. However, for convenience of description, the inside of the outer heel 110 and the inner heel 120 are described as having a circular shape. Further, in the case of a polygonal shape, the diameter should be replaced with the width, but for convenience of description, 'diameter' is used.

According to the present invention, the outer heel 110 is formed with a body portion fixed to the rear and lower surface of the sole 101 of the high heel shoe and having a wider upper surface and narrowing towards a lower surface thereof to secure stable supporting force while walking. The upper portion of the outer heel 110 has a circular or semi-circular cross section, and the lower portion of the outer heel 110 has a circular or semi-circular cross section. The inner heel 120 is inserted into the outer heel 110. The outer heel 110 includes a larger-diameter path portion 111 where the coupling cap 160 is seated, a medium-diameter path portion 112, which communicates with the larger-diameter path portion 111, is positioned under the larger-diameter path portion 111, and has a smaller diameter than the larger-diameter path portion 111, and where the inner heel upper portion 121 and the elastic spring 130 are positioned, a bottleneck space portion 113, which communicates with the medium-diameter path portion 112, is positioned under the medium-diameter path portion 112, and has a smaller diameter than the medium-diameter path portion 112 and where the stepped portion 121*a* is seated, and a smaller-diameter path portion 114, which communicates with the bottleneck space portion 113, is positioned under the bottleneck space portion 113, and has a smaller diameter than the bottleneck space portion 113 and where the inner heel lower portion 122 is inserted.

The upper end of the larger-diameter path portion 111 is open to, and communicates with the outside, and faces the bottom of the sole 101 of the shoe. The larger-diameter path portion 111 has a step to seat the fastening cover 160. The medium-diameter path portion 112 is positioned under the larger-diameter path portion 111, communicates with the larger-diameter path portion 111, and has a step to seat the elastic spring 130.

The inner heel 120 is inserted into the larger-diameter path portion 111 and the medium-diameter path portion 112. The elastic spring 130 is fitted over the inner heel upper portion 121, and the fastening cover 160 is inserted from above the inner heel upper portion 121 and the elastic spring 130.

As such, when the outer heel 110 moves up or down, the structures may collide with each other and cause noise inside the outer heel 110 into which the fastening cover 160, the inner heel 120, and the elastic spring 130 have been inserted. Thus, a lubricant, such as gel or grease, may be applied to the structures to prevent noise and lead to smooth elevation of the outer heel 110 while being prevented leakage.

The bottleneck space portion 113 positioned under the medium-diameter path portion 112 is a space where the stepped portion 121*a* is seated. A packing portion 123 where the stepped portion 121*a* is inserted and which is fitted over a lower portion of the stepped portion 121*a* may be fitted into the bottleneck space portion 113.

The packing portion 123 is formed of a bendable elastic (soft) material and allows the inner heel 120 to be installed through a central portion thereof to seal the space filled with the lubricant 190 and prevent the lubricant 190 from falling down even when the inner heel 120 moves up and down.

The packing portion 123 may be fitted over the inner heel lower portion 122, and another packing of the same shape may be fitted over the inner heel upper portion 121. As such, the two packings are coupled over and under the stepped portion 121*a* to seal the bottleneck space portion 113.

The fastening cover 160 is inserted and seated in the larger-diameter path portion 111 and allows the inner heel upper portion 121 and the elastic spring 130 to be inserted thereinto. A fastening screw thread 164 is formed on the outer circumstantial surface of the fastening cover 160 and is strongly fastened with the inside of the outer heel. Corresponding to the fastening screw thread 164, a screw thread is formed on the inner circumferential surface of the larger-diameter path portion 111 of the outer heel. By rotating the fastening cover 160 using a wrench or screwdriver on the fastening cover 160, the fastening cover 160 is moved up or down the outer heel so that its height (position) is determined. The fastening cover 160 is screwed and firmly fastened with the outer heel 110. If the fastening cover 160 is rotated and decoupled from the outer heel, the components including the inner heel 120 and the elastic spring 130 may be replaced or repaired.

The fastening cover 160 includes an inner heel support 161, which protrudes upward, has an open lower end, and allows the inner heel upper portion 121 to be inserted through the open lower end when the outer heel 110 descends, and an elastic spring support 162, which is formed under the inner heel support 161, allows the elastic spring 130 to be inserted thereinto, and has a larger diameter than the inner heel support 161.

Thus, the fastening cover 160 is constituted of the inner heel support 161 with a smaller diameter and the elastic spring support 162 with an enlarged diameter, positioned under the inner heel support 161 and connected with the inner heel support 161.

The inner heel upper portion 121 has a smaller diameter than the inner heel support 161 to be moved up and down in the inner heel support 161. The inner heel upper portion 121 vertically comes in line or surface contact with the inner heel support 161 which has a certain height and is moved up and down inside the inner heel support 161. By the surface contact, the inner heel 120 is strongly and stably supported.

In this case, the upper surface of the fastening cover 160 has an upper hole through which the inner heel support 161 passes. The diameter of the upper hole 163 is formed to be slightly larger than the diameter of the inner heel upper portion 121. The inner heel support 161 allows the inner heel upper portion 121 to slightly penetrate when the outer heel 110 descends, thereby strengthening the lateral support of the inner heel 120. When the user moves, the user's weight affects not only the upper portion of the inner heel 120 but also the side, and at this time, the inner side of the inner heel support 161 and the inner heel upper portion 121 vertically come in line contact or surface contact with each other, supporting the side of the inner heel upper portion 121, Since the inner heel support 161 has a certain height and, at the height, comes in contact with the inner heel upper portion 121 while supporting the side of the inner heel 120, the heel of the high heel shoe may remain stable. Since the internal area of the heel of the high heel shoe is not large, the fastening cover 160 may not be manufactured in a large size. Thus, even a slight protrusion of the inner heel upper portion 121 beyond the upper hole 163 produces a significant effect on supporting the inner heel 120. Further, the upper hole 163 also functions to adjust the pressure inside the larger-diameter path portion 111 when the elastic spring 130 is compressed.

The elastic spring 130 is inserted into the elastic spring support 162 having a larger diameter than the inner heel support 161 from under the fastening cover 160, and is fitted into the elastic spring support 162 to be limited in movement and allow the weight to be distributed.

A lower portion of the elastic spring 130 is fitted over an upper portion of the inner heel upper portion 121 and is supported by the stepped portion 121*a* positioned under the inner heel upper portion 121. The fastening cover 160 is moved down by the descent of the outer heel 110, and the elastic spring 130 is compressed by the pressing force of the fastening cover 160.

The inner heel support 161 allows the inner heel 120 alone to be inserted therethrough to support the side of the inner heel 120, and the elastic spring support 162 allows the inner heel 120 and the elastic spring 130 to be inserted therethrough to support the elastic spring. The upper portion of the elastic spring 130 is supported on a cross section where the diameter expands from the inner heel support 161 to the elastic spring support 162.

Meanwhile, although the drawings illustrate a state in which the outer heel 110 is coupled to the sole 101 and the fastening cover 160 is slightly projected beyond the upper portion of the outer heel 110, the state may be varied depending on the screwing state between the fastening screw thread 164 of the fastening cover 160 and the inside of the outer heel.

An upper surface of the outer heel 110 may be fixed to a lower surface of the sole 101 using separate fastening means (e.g., a bolt(s) or glue) and, to prevent the user from feeling an empty space therebetween, a coupling means (not shown) with a supportable structure, such as a washer, may be placed on the upper surface of the outer heel 110, e.g., on the larger-diameter path portion 111.

The stepped portion 121*a* is formed, due to a difference in diameter, at the connected portion between the inner heel upper portion 121 and the inner heel lower portion 122. If the inner heel 120 is inserted into the outer heel 110, the inner heel upper portion 121, the inner heel lower portion 122, and the stepped portion 121*a* are positioned in the larger-diameter path portion 11 the medium-diameter path portion 112, and the smaller-diameter path portion 114, respectively, formed inside the outer heel 110.

If the elastic spring 130 and the fastening cover 160 are inserted through the larger-diameter path portion 111 after the inner heel 120 is positioned inside the outer heel 110, the lower end of the elastic spring 130 is fitted over the inner heel upper portion 121 and is elastically supported by the stepped portion 121*a*, and the upper end of the elastic spring 130 is inserted into, and elastically supported by, the elastic spring support 162 of the fastening cover 160.

Therefore, if external impact force is applied to the upper side of the outer heel 110 as the user walks, the outer heel 110 is moved down and, simultaneously, the inner heel upper portion 121 of the inner heel 120 is relatively elastically lifted or lowered and extended or contracted between the larger-diameter path portion 111 and the medium-diameter path portion 112, mitigating the external impact force.

Figure 5:
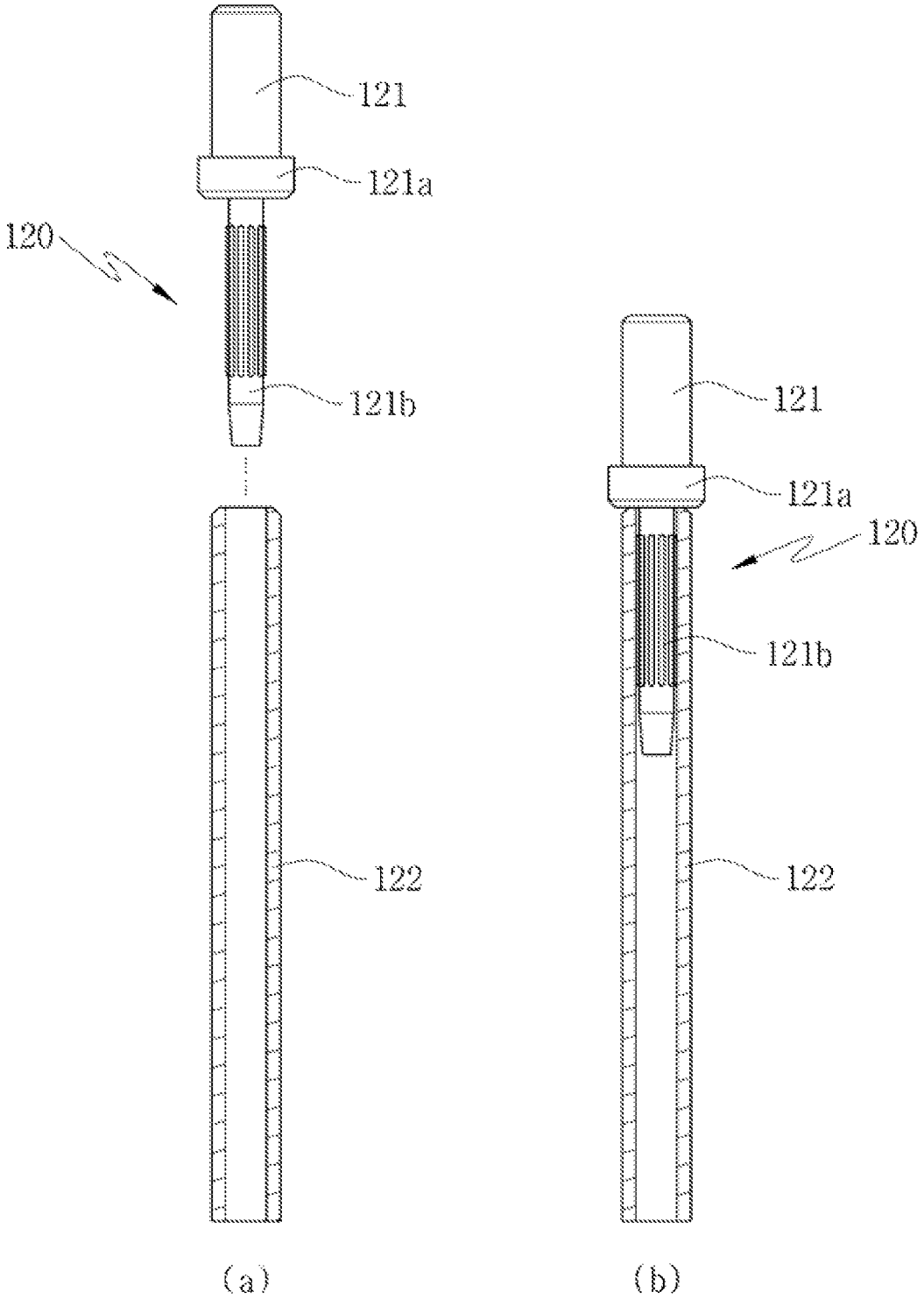
FIG. 5 illustrates a separated state and coupled state of an inner heel of a heel for absorbing shocks, having a shock absorber and attached to a high heel shoe according to another embodiment of the present invention.

Meanwhile, as illustrated in FIG. 5, according to another embodiment of the present invention, an inner heel 120 may have an inner heel upper portion 121 and an inner heel lower portion 122 formed separately from each other and a fitting portion 121*b* protruding from the bottom of a stepped portion 121*a* and fitted into an upper portion of the inner heel lower portion 122.

A plurality of protrusions are formed on the outer circumferential surface of the fitting portion 121*b* and are spaced apart from one another at a predetermined interval to prevent the fitting portion 121*b*, which is press-fitted into the inner heel lower portion 122, from escaping off the inner heel lower portion 122, thus allowing for firm and secure fastening.

Meanwhile, the top piece 140 includes a supporting body portion 141 contacting the ground and a fitting protrusion 142 provided on an upper surface of the supporting body portion 141 and installed and fixed to an end of the inner heel lower portion 122 of the inner heel 120. An upper end of the top piece 140 coupled with the protection cap 150 means an upper end of the supporting body portion 141, not an upper end of the fitting protrusion 142.

If the bottom of the supporting body portion 141 is worn and torn by long term use, the top piece 140 may easily be repaired or replaced by pulling out the fitting protrusion 142 from the end of the inner heel 120.

The protection cap 150 according to the present invention is installed so that its upper end is fitted over the lower end of the outer heel 110 and the lower end thereof is supported on the upper surface of the supporting body portion 141 of the top piece 140.

Thus, the outer heel 110 is lifted or lowered along the inner wall of the protection cap 150.

According to the present invention, the protection cap 150 may prevent an end of the inner heel lower portion 122 of the inner heel 120 from exposure to the outside through a space (which is a stroke area where the outer heel 110 is lifted or lowered) formed between a lower end of the outer heel 110 and the supporting body portion 141 of the top piece 140, providing an aesthetic look. Further, the protection cap 150 blocks influx of, e.g., dust, from the outside to the inside through the inner heel lower portion 122, enhancing durability.

When the outer heel 110 descends, the end of the outer heel 110 comes in tight contact with the upper surface of the supporting body portion 141 of the top piece, so that the inner heel lower portion 122 is prevented from being exposed to the outside. However, if the outer heel 110 ascends, the inner heel lower portion 122 may have a chance of being exposed to the outside and, in such a case, the protection cap 150 may block such exposure to prevent influx of a foreign body.

The protection cap 150 is formed in a hollow cylindrical shape and has a first support reinforcing portion 151, formed at a lower end thereof to allow the fitting protrusion 142 of the top piece 140 to pass through a central portion thereof and formed with a surface which the upper surface of the supporting body portion 141 contacts, preventing cracks or damage.

The first support reinforcing portion 151 may be a bottom surface of the protection cap 150 and have a through hole, through which the fitting protrusion 142 is inserted, formed in the center thereof and may contact the upper surface of the supporting body portion 141 to stably support the weight.

Figure 6:
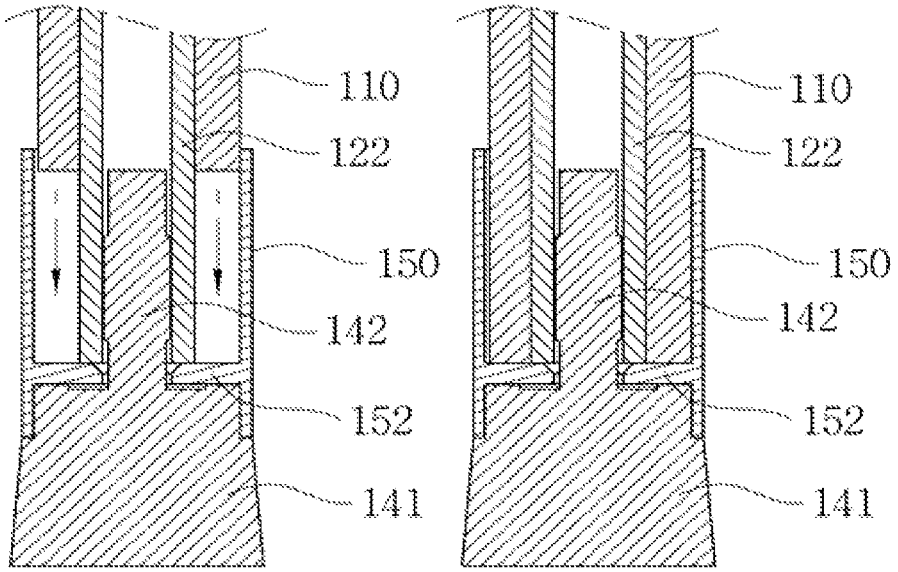
FIG. 6 is a cross-sectional view illustrating an operational state of a heel for absorbing shocks, having a shock absorber and attached to a high heel shoe according to another embodiment of the present invention.
Figure 6:
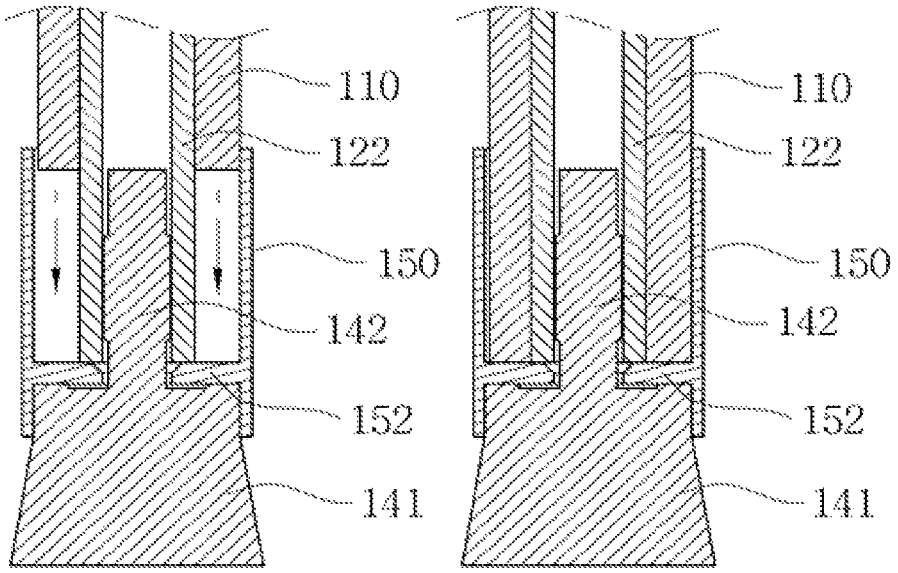

Meanwhile, as illustrated in FIG. 6, according to another embodiment of the present invention, the protection cap 150 has a second support reinforcing portion 152 formed to protrude inside thereof to allow an upper end of the supporting body portion 141 to be inserted and fixed into the protection cap 150 and to be contacted by the upper surface of the supporting body portion 141.

The protruding surface of the second support reinforcing portion 152 is positioned further inside than the first support reinforcing portion 151 is, and the second support reinforcing portion 152 is formed to allow the supporting body portion 141 to be inserted thereinto, stably supporting the outer heel 110 and the inner heel 120.

In this case, the supporting body portion 141 may have a groove formed along an upper outer circumferential surface thereof to fit the lower end of the protection cap 150 as shown in FIG. 6(*a*), or the supporting body portion 141 may be formed to have a smaller diameter than the lower end of the protection cap 150 to contact the second support reinforcing portion 152 in the inside of the protection cap 150 as shown in FIG. 6(*b*).

A brand name, logo, characters, or pattern may be formed on the outer circumferential surface, i.e., the body, of the so-configured protection cap 150, for promotion purposes.

According to the present invention, the inner heel 120 is inserted and installed through the larger-diameter path portion 111, the medium-diameter path portion 112, the bottleneck space portion 113, and the smaller-diameter path portion 114 formed inside the outer heel 110, and the inner heel 120 and the elastic spring 130 are fixed and supported using the fastening cover 160.

The inner heel lower portion 122 of the inner heel 120 may be projected and exposed to the outside through the lower end of the outer heel 110. In this case, the protection cap 150 is inserted and installed through the lower end of the outer heel 110, and the top piece 140 is then installed. Thus, the heel 100 for absorbing shocks, having a shock absorber and attached to a high heel shoe, according to the present invention, is completed.

According to the present invention, the lower portion of the outer heel 110 has a circular cross section and may be moved up or down, but not rotated, inside the protection cap 150.

The upper portion of the outer heel 110 has a semi-circular cross section. As used herein, the term "semi-circular shape" refers to an overall (in three-dimensional (3D) tunnel shape or a greenhouse shape and, in some cases, be also referred to as a half-moon shape.

The protection cap 150 fitted over the outer heel 110 may be formed in a cylindrical shape to have a predetermined height to have a space so that a brand name for the high heel shoe may be formed on the outer surface of the protection cap 150.

The upper end of the top piece may be formed to be larger in diameter than the lower end of the outer heel 110 so that the lower end of the outer heel 110 is supported on the upper end of the top piece 140.

Since the lower end of the outer heel 110 is slid downward to contact the top piece 140 when a weight is applied, the lower end of the outer heel 110 needs to be smaller in diameter than the upper end of the supporting body portion 141.

Meanwhile, when a weight is applied, the protection cap 150 ascends along the outer surface of the outer heel 110 (the outer heel descends). Since the outer heel 110 gradually increases in diameter upwards, the inner diameter of the upper end of the protection cap 150 needs to be larger than the diameter at the maximum height where it contacts the outer heel 110 so that it is smoothly lowered to the upper end of the top piece 140 when the weight is removed.

As such, according to the present invention, if a load is applied to the outer heel 110 when the user walks, the elastic spring 130, fitted and installed over the upper portion of the inner heel 120, is elastically compressed. At this time, the upper end of the elastic spring 130 is elastically supported at the upper side of the larger-diameter path portion 111 of the outer heel 110, and the lower end of the elastic spring 130 is elastically supported and compressed by the stepped portion 121*a* of the inner heel 120.

Then, the inner heel 120 slidingly ascends while the outer heel 110 slidingly descend. In this case, the lower end of the outer heel 110 is lowered up to the upper surface of the supporting body portion 141 of the top piece 140, mitigating the impact load. When the load is removed, the outer heel 110 and the inner heel 120 return to their original positions by the elastic restoring force of the elastic spring 130.

As such, if a load is applied to the outer heel 110 while the user walks, the impact load applied to the user's sole is mitigated by the elastic force of the elastic spring 130 according to the above-described operation, thus protecting the user's knees.

Further, the present invention allows for stable support without movement of the structure inserted in the outer heel 110, allowing the user to stably walk although the outer heel 110 is laterally impacted or the user is slipped.

Further, the heel 100 for absorbing shocks, having a shock absorber and attached to a high heel shoe according to the present invention reduces impacts applied to the user's feet by mitigating impact from the ground while the user walks, protecting the user's joints. Further, the heel 100 according to the present invention allows for a longer high heel to make the user look taller and prettier while going well with the clothes and allows for various fashion styles.

As described above, according to the present invention, a heel 100 for absorbing shocks, having a shock absorber and attached to a high heel shoe includes an outer heel 110 fixedly installed on a rear surface of a sole 101 of a high heel shoe, an inner heel 120 having an elastic spring 130 installed at an upper side thereof and coupled inside the outer heel 110, and a top piece 140 fixedly installed on a lower end of the inner heel 120 to be replaceable. A cylindrical protection cap 150 is inserted and installed over a lower end of the outer heel 110 to prevent the lower end of the inner heel 120 from being exposed to the outside. A fastening cover 160 coupled from over the inner heel 120 and the elastic spring 130 is inserted into the outer heel 110. The protection cap 150 may give an aesthetic look and block influx of dust to the inner heel 120. The weight may be distributed through the fastening cover 160, enhancing use durability. When the user walks, the elastic spring 130 mitigates impact while the outer heel 110 slidingly ascends or descends.

Further, according to the present invention, the cylindrical protection cap 150 is inserted and installed over the lower end of the outer heel 110 to block the lower end of the inner heel 120 from exposure to the outside, thus giving an aesthetic look while preventing influx of dust to the inner heel 120, thereby significantly enhancing use durability.

Further, according to the present invention, a brand name may be formed on the outer surface of the protection cap 150, allowing for effective promotion of the heel for absorbing shocks of the present invention.

Further, according to the present invention, a stepped portion 121*a*, which has a larger diameter than the inner heel upper portion 121 and the inner heel lower portion 122, is formed under the lower portion of the inner heel upper portion 121 of the inner heel 120 coupled into the outer heel 110. The elastic spring 130 is fitted over the inner heel upper portion 121 and fixed. The fastening cover 160, where the inner heel upper portion 121 and the upper surface of the elastic spring 130 are inserted and fixed, is coupled not to fall down the outer heel 110 and not to move to two opposite sides, increasing fastening stability.

Further, according to the present invention, the movement of the elastic spring 130 is limited by the fastening cover 160 and the inner heel 120 inserted into the outer heel 110, and the elastic spring 130 distributes the impact force, leading to increased sturdiness and durability.

Further, according to the present invention, a lubricant 190 is injected into the inside of the outer heel 110 where the elastic spring 130 and the inner heel 120 are inserted, preventing clunking noises between the structures. The packing portion 123 fitted over the inner heel lower portion 122 is installed under the stepped portion 121*a* and inside the outer heel 110 to prevent the lubricant 190 from dropping and leaking, thus increasing durability.

Further, according to the present invention, the protection cap 150 may easily be attached or removed by the user for replacement or design changing purposes.

LEGEND OF REFERENCE NUMBERS

100: heel for absorbing shocks, having a shock absorber and attached to a high heel shoe
101: sole
110: outer heel 111: larger-diameter path portion 112: medium-diameter path portion
113: bottleneck space portion 114: smaller-diameter path portion
120: inner heel 121: inner heel upper portion 121*a*: stepped portion
121*b*: fitting portion 122: inner heel lower portion 123: packing portion
130: elastic spring
140: top piece 141: supporting body portion 142: fitting protrusion
150: protection cap 151: first support reinforcing portion 152: second support reinforcing portion
160: fastening cover 161: inner heel support 162: elastic spring support
163: upper hole 164: fastening screw thread
190: lubricant

The invention claimed is:

1. A heel for absorbing shocks, having a shock absorber and attached to a high heel shoe, comprising:

an outer heel (110) fixed to a lower rear surface of a sole (101) of the high heel shoe;

an inner heel (120) inserted and coupled into the outer heel (110) and including an inner heel upper portion (121) formed at an upper side, an inner heel lower portion (122) formed at a lower side, and a stepped portion (121*a*) formed to have a larger diameter than the inner heel upper portion (121) between the inner heel upper portion (121) and the inner heel lower portion (122);

an elastic spring (130) positioned inside the outer heel (110), fitted over the inner heel upper portion (121), and stuck to an upper portion of the stepped portion (121*a*) to be compressed when the outer heel (110) descends;

a top piece (140) coupled to a lower end of the inner heel lower portion (122) and supported on a ground; and a fastening cover (160) positioned over the inner heel (120) and having an upper hole (163) with an open upper surface, the inner heel (120) and the elastic spring (130) inserted into the fastening cover (160), wherein the inner heel (120) includes the inner heel upper portion (121) and the inner heel lower portion (122) separately formed, and wherein a fitting portion (121*b*) protrudes from a lower portion of the stepped portion (121*a*) to be fitted into an upper portion of the inner heel lower portion (122).

2. The heel of claim 1, wherein the fastening cover (160) includes:

an inner heel support (161), into which the inner heel upper portion (121) is inserted; and an elastic spring support (162), into which the elastic spring (130) and the inner heel upper portion (121) are inserted, under the inner heel support (161), the elastic spring support (162) having a larger diameter than the inner heel support (161), and herein a fastening screw thread (164) is formed on an outer circumferential surface of the fastening cover (160) and is screwed with the outer heel (110) to determine a height of the outer heel (110).

3. The heel of claim 2, wherein when the outer heel (110) descends, the inner heel upper portion (121) protrudes through the upper hole (163).

4. The heel of claim 1, wherein the outer heel (110) includes a larger-diameter path portion (111) to seat the fastening cover (160), a medium-diameter path portion (112) communicating with the larger-diameter path portion (111) and to allow the inner heel upper portion (121) and the elastic spring (130) to be positioned therein, a bottleneck space portion (113) communicating with the medium-diameter path portion (112) and positioned under the medium-diameter path portion (112) to seat the stepped portion (121*a*), and a smaller-diameter path portion (114) communicating with the bottleneck space portion (113) and positioned under the bottleneck space portion (113) to allow the inner heel lower portion (122) to be inserted thereto, the smaller-diameter path portion (114) having a smaller diameter than the bottleneck space portion (113).

5. The heel of claim 4, wherein a lubricant (190) is injected to the larger-diameter path portion (111) and the medium-diameter path portion (112) of the outer heel (110), wherein a packing portion (123) is fitted over a lower end of the stepped portion (121*a*) to prevent leakage of the lubricant (190), and wherein the packing portion (123) is inserted into the bottleneck space portion (113).

6. The heel of claim 1, wherein a lower end of the inner heel lower portion (122) is projected downwards beyond a lower end of the outer heel (110) to be exposed to an outside and connected to the top piece (140), wherein if a load from a user is applied, an end of the outer heel (110) comes in contact with the top piece (140), and wherein the heel further comprises a protection cap (150) having an upper end positioned higher than the lower end of the outer heel (110) and a lower end positioned over the top piece (140), inserted while surrounding the outer heel (110) to block the lower end of the inner heel lower portion (122) to an outside, and allowing the outer heel (110) to be moved up or down thereinside by the user's load.

* * * * *